US005997364A

United States Patent [19]

Matsuoka et al.

[11] Patent Number: 5,997,364

[45] Date of Patent: Dec. 7, 1999

[54] ELECTRICAL CONNECTOR

[75] Inventors: Hiroyuki Matsuoka; Hajime Okada, both of Yokkaichi, Japan

[73] Assignee: Sumitomo Wiring Systems, Ltd., Japan

[21] Appl. No.: 09/005,033

[22] Filed: Jan. 9, 1998

[51] Int. Cl.[6] ..... H01R 13/436

[52] U.S. Cl. ..... 439/752; 439/595

[58] Field of Search ..... 439/752, 595

[56] References Cited

U.S. PATENT DOCUMENTS 4,846,737 7/1989 Jorroch et al. ..... 439/752
5,468,162 11/1995 Oda ..... 439/752

FOREIGN PATENT DOCUMENTS 0 673 084 9/1995 European Pat. Off. .
19532381 6/1997 Germany .
WO 96/32760 10/1996 WIPO .

*Primary Examiner*—Gary F. Paumen
*Attorney, Agent, or Firm*—Banner & Witcoff, Ltd.

[57] ABSTRACT

An electrical connector comprises a housing 51 having a plurality of electrical terminals 12 retained by respective lances 16, and a retainer 41 movable from a disengaged position to an engaged position to provide a secondary latch for the terminals 12. In order to prevent accidental forcible removal of the terminal 12, the retainer 41 includes a shutter 42 which, when the retainer 41 is in the disengaged position, occludes access to the terminals 12 and provides access to release openings 54, for the respective lances 16 only. In the engaged position, the shutter 42 provides access to the terminals 12 for connection with a mating connector.

9 Claims, 4 Drawing Sheets

ELECTRICAL CONNECTOR

TECHNICAL FIELD

This invention relates to an electrical connector of the kind having a removable terminal. Such a connector is common in a wiring harness of an automobile.

BACKGROUND TO THE INVENTION

An electrical connector usually comprises a moulded plastic casing having a plurality of chambers adapted to receive electrical terminals of metal. The terminals are inserted individually into a respective chamber and retained by a one-way latch. The latch usually consists of a bent up lance of the terminal which engages behind an abutment of the casing in the installed condition. Such a construction is very common.

The casing may further include a retainer insertable in the housing into engagement with the terminals. Such a retainer has the function of providing a secondary latch to the terminals, and of ensuring that the terminals are fully inserted in the casing. Again, such a construction is very common.

It may be necessary to remove an individual terminal for repair or replacement. The correct method is to release the retainer and bend the lance out of engagement with the abutment; this permits the terminal to be withdrawn from its chamber. However, whilst the existence of a retainer is usually obvious, an operator may have difficulty in identifying how to release the lance, or he may not realise that a lance is present. In either case direct force may be applied to the terminal, and this can result in damage or destruction which may be difficult to rectify.

The present invention aims to provide a solution to the above mentioned problem.

SUMMARY OF THE INVENTION

According to the invention there is provided an electrical connector comprising a housing having a plurality of through apertures to receive respective electrical terminals, each terminal having a primary latch with the housing to retain the terminal in the respective aperture, the connector further including a retainer movable inwardly of the housing from a temporary position in which terminals may be inserted into respective apertures, to a final position in which terminals are retained, the retainer constituting a secondary latch in the final position, the connector being adapted to receive mating terminals of another connector through end openings of said aperture, and having adjacent release openings for insertion of a release tool to disengage the primary latch of a respective terminal, wherein said retainer has a shutter thereon, the shutter occluding said end openings in the temporary position and permitting access to said release openings only, and said shutter being movable with said retainer to permit access to said end openings in the final position.

Preferably the primary latch is a lance of a terminal engageable with an abutment of the housing. In the preferred embodiment the primary latch constitutes one-way engagement means to permit automatic retention of a terminal when inserted into a respective aperture.

The end openings and release openings are preferably arranged in a regular grid, and the shutter preferably has a corresponding regular grid for access openings to permit insertion of a corresponding terminal or a release tool, depending on whether the shutter is in the temporary or final position.

In the preferred embodiment the shutter is guided in a slot of the housing, this slot extending perpendicularly to the axis of said apertures.

BRIEF DESCRIPTION OF DRAWINGS

Other features of the invention will be apparent from the following description of a preferred embodiment shown by way of example only in the accompanying drawings in which.

DESCRIPTION OF PREFERRED EMBODIMENT

Figure 1:
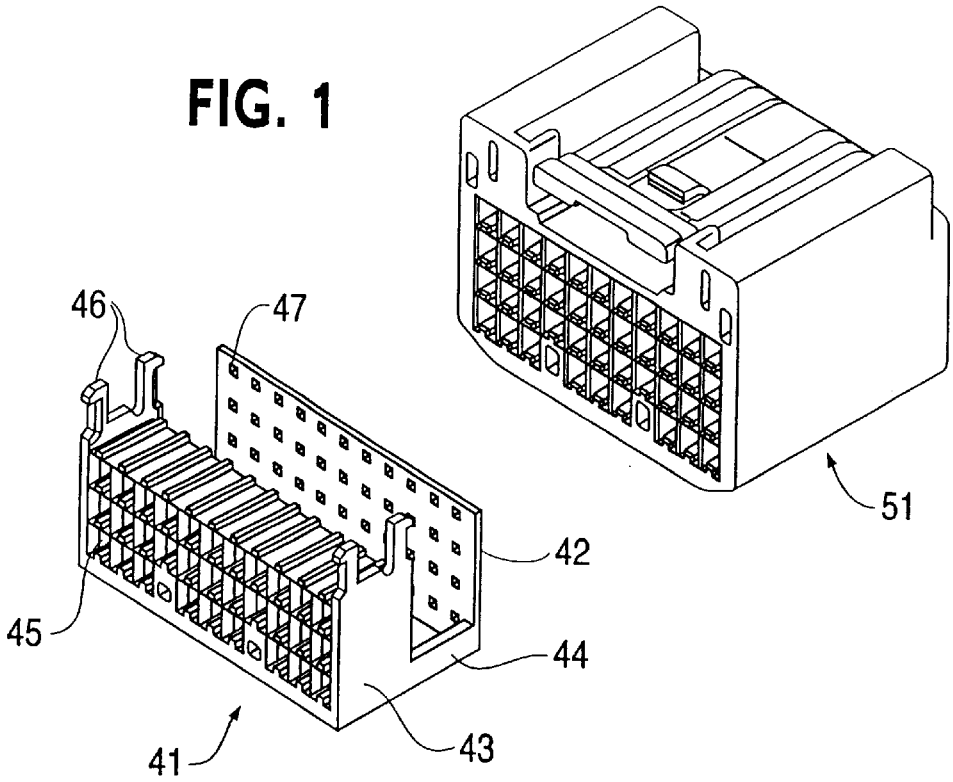
FIG. 1 is a perspective view of an electrical connector casing and retainer according to the present invention.
Figure 2:
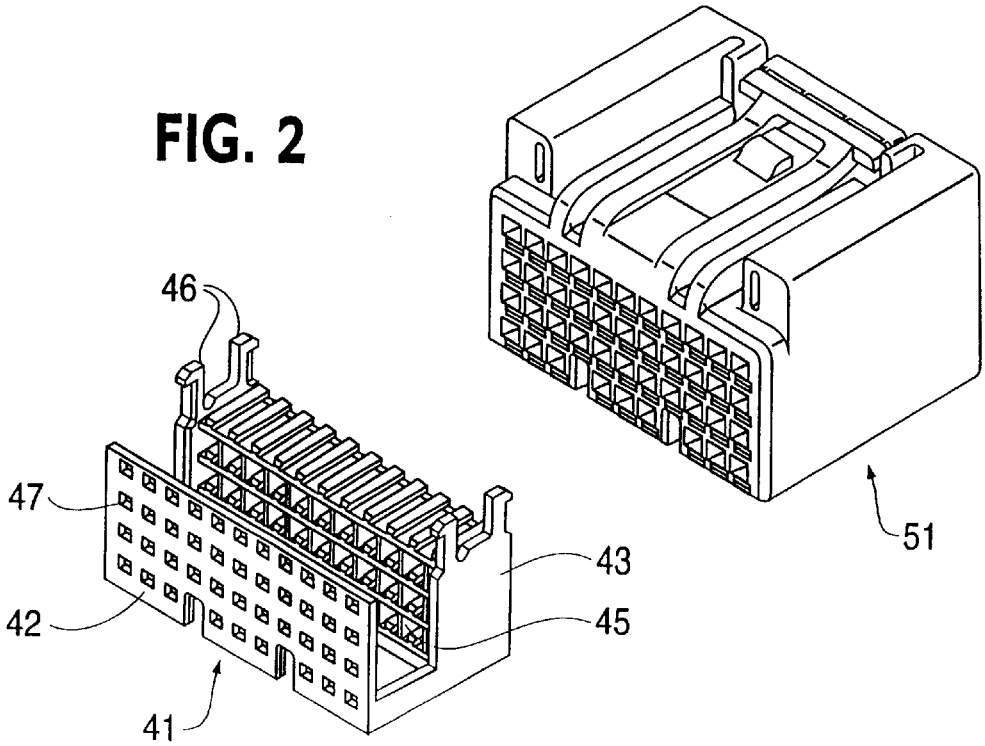
FIG. 2 corresponds to FIG. 1 but shows a view from the opposite direction.

With reference to FIGS. 9–12, a prior art connector typically comprises a moulded plastics casing 10 having a plurality of chambers 11 to receive individual electrical terminals 12 of metal. As illustrated the chambers are four deep, and they may be at least ten wide. The general arrangement of such a casing is apparent from FIGS. 1 & 2.

Each terminal has a wire attached to crimping tabs 13 although for the purpose of illustration the wires are omitted, and the tabs 13 not closed.

The chambers extend through the casing, one end opening 14 being for the associated wire, and the other end opening 15 being adapted to receive a terminal of a mating connector. As illustrated, the terminals 12 are female, and intended to receive a male terminal through the opening 15.

A bent up tab or lance 16 of each terminal engages behind an abutment 17 of the casing. In use the terminal is inserted into the casing from the opening 14, and the tab is bent resiliently down by the casing until it passes the abutment 17, whereupon it springs up to prevent withdrawal of the terminal. Further forward movement of the terminal is obstructed by an end wall 19, as illustrated.

Figure 3:
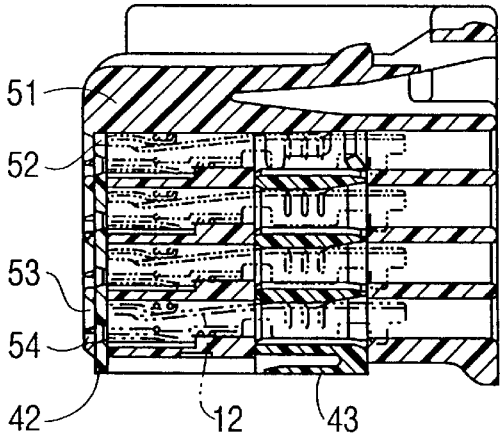
FIGS. 3 & 4 are axial cross-sections through a retainer and casing in combination, and illustrating the temporary and fully fitted conditions.
Figure 4:
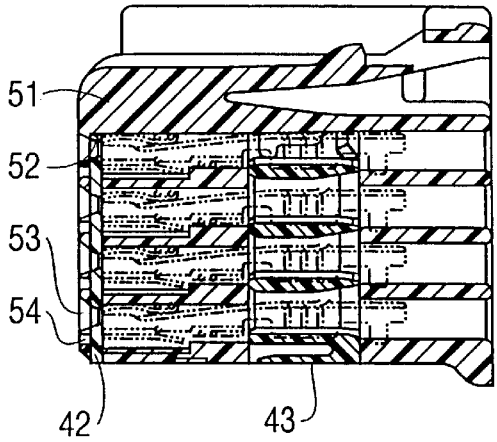

A retainer 21 is loosely housed in the casing and has apertures 22 corresponding to each of the chambers 11. In the temporary position of FIGS. 3 and 5, the terminals are freely insertable. Once the terminals are fully inserted the retainer is moved inwardly to the position of FIGS. 4 and 6 where it engages each terminal to provide a secondary latch. If a terminal is not fully inserted the retainer will not move to the final position, and accordingly the retainer serves as an indicator of incorrect assembly of the connector as well as providing a secondary latch.

A resilient latch is usually provided to retain the retainer in the final position.

A series of release openings 18 are provided; one for each chamber 11. These permit insertion of a small tool to depress a respective lance and thereby permit the terminal to be withdrawn (after the retainer has also been moved to the temporary position).

Such a general connector construction is very common. The retainer 21 is usually obvious, and an operator will know that it must be moved to the temporary position prior to removal of a terminal. However an operator may fail to release the lance, or apply force through opening 15 rather than release opening 18, and thus a terminal or the connector itself may be damaged if removal is attempted.

The present invention is illustrated in FIGS. 1–8.

Figure 5:
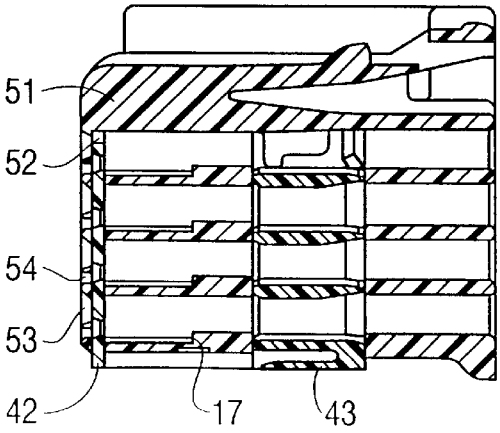
FIGS. 5 & 6 correspond to FIGS. 3 and 4 but with terminals omitted for clarity.
Figure 6:
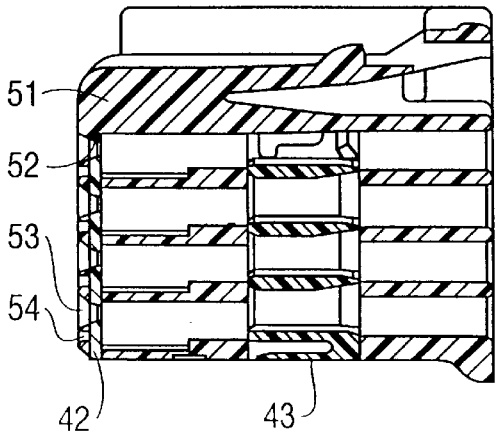

The retainer 41 is conventional but has a shutter 42 attached to a main body 43 by opposite arms 44. The main body 43 is conventional, and includes apertures 45 and resilient latches 46 for engagement in appropriate recesses of a casing 51. The shutter 42 has a plurality of small openings 47, each just big enough to receive a male terminal. The shutter 42 slides in a channel 52 moulded in the casing 51, as best illustrated in FIGS. 5 and 6.

In the temporary position of the retainer 41, the terminals are insertable as before, each lance engaging a respective abutment. Provided each terminal is correctly installed, the retainer can be moved to the final position, and in these respects is conventional.

However in the temporary position (FIGS. 3 and 5) the shutter occludes the terminal opening 53 whilst permitting a small tool to pass through the release opening 54. In the final position (FIGS. 4 and 6), the release opening is closed, but the terminal opening is uncovered to permit engagement with another connector.

Figure 7:
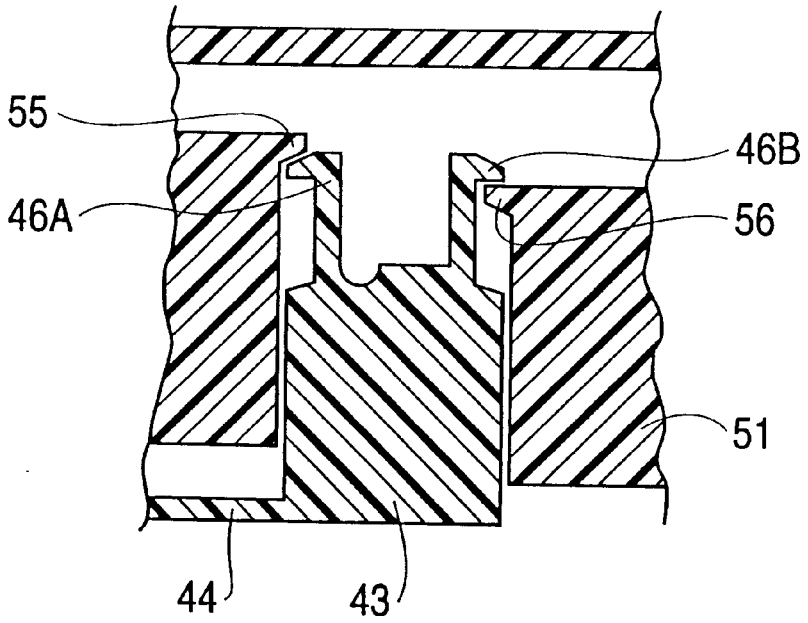
FIGS. 7 & 8 are other, partial axial cross sections through the retainer and casing in combination, and illustrating the temporary and fully fitted conditions.
Figure 8:
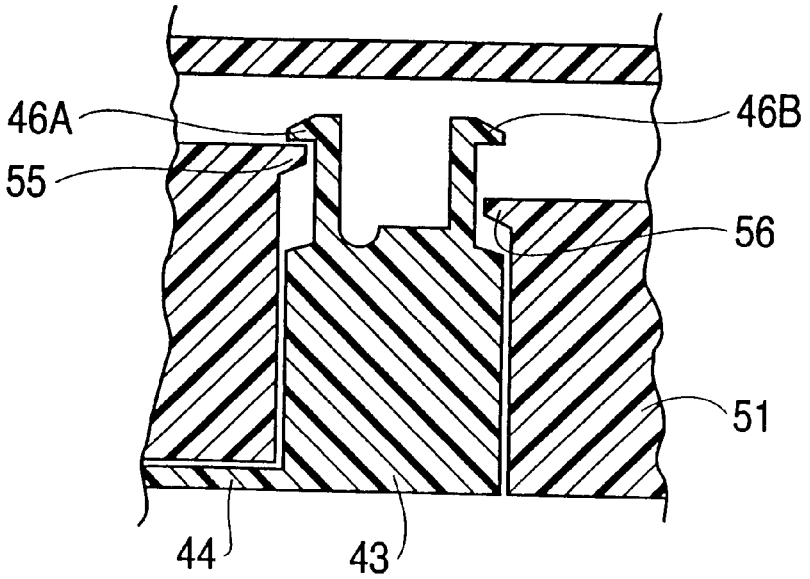
Figure 9:
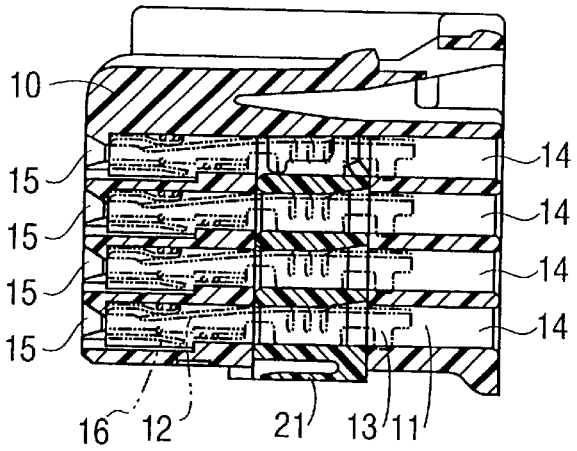
FIG. 9 (PRIOR ART)
FIGS. 9–12 corresponds to FIGS. 3–6, and show a typical prior art arrangement.
Figure 10:
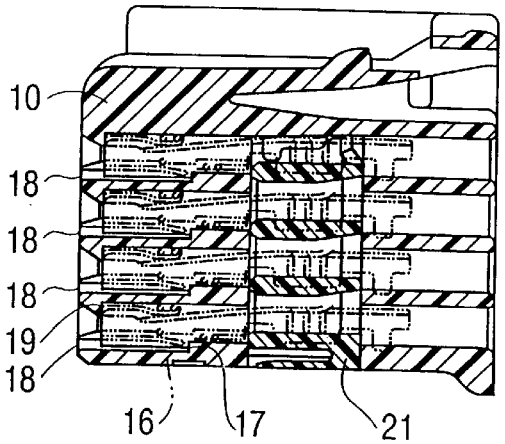
FIG. 10 (PRIOR ART)
Figure 11:
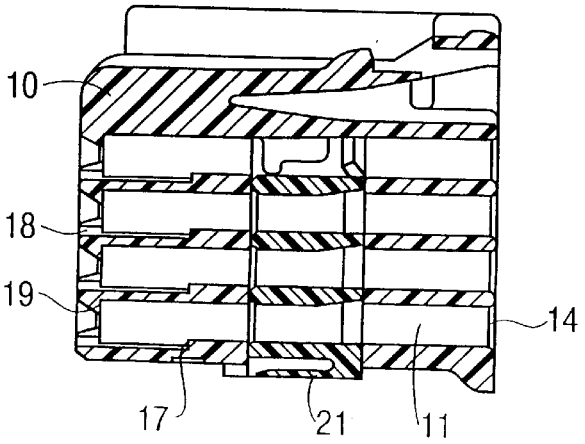
FIG. 11 (PRIOR ART)
Figure 12:
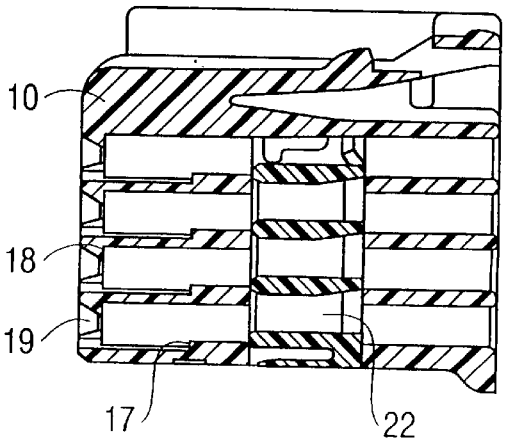
FIG. 12 (PRIOR ART)

FIGS. 7 and 8 show a detent arrangement to retain the retainer in the temporary and final positions.

In FIG. 7 the retainer body 43 is in the temporary position and a first resilient leg 46A engages proximally of an abutment 55 of the casing 51. A second resilient leg 46B engages distally of an opposite abutment 56 of the casing 51. As illustrated the legs 46A, 46B are of equal length, and the abutments 55, 56 are staggered. The arrangement ensures that the retainer is held releasably against movement from the temporary position; the arm 44 is spaced from the casing 51.

FIG. 8 illustrates the final position in which the leg 46A has moved resiliently past the abutment 55 to engage the distal side thereof; the arm 44 moves against the casing 51 so that the retainer is held in the final position.

The distance which the retainer moves between the temporary and final positions is equal to the open end and closed positions of the shutter 42. In other words the pitch is the same.

Thus the shutter ensures that when the retainer is in the temporary position, it is not possible to apply a force directly to a terminal, and damage is thereby avoided. In fact, the shutter ensures that a release tool can only be inserted through the release opening when the retainer is in the temporary position, and thus is a guide to correct removal of a defective terminal.

We claim:

1. An electrical connector comprising a housing having a plurality of through apertures to receive respective electrical terminals, each terminal having a primary latch with the housing to retain the terminal in the respective aperture, the connector further including a retainer movable inwardly of the housing from a temporary position in which the terminals may be inserted into respective apertures, to a final position in which the terminals are retained, the retainer having detents cooperating with said housing for holding the retainer in the temporary and final positions, and the retainer constituting a secondary latch for the terminals in the final position, the connector being adapted to receive mating terminals of another connector through end openings for said apertures in the housing, and having adjacent release openings in the housing for insertion of a release tool to disengage the primary latch of a respective terminal, wherein said retainer has a shutter thereon provided with a plurality of access openings, the shutter being positioned in the temporary position to occlude the end openings and to align the access openings with the release openings so as permit access only to said release openings, and said shutter being movable with said retainer to align the access openings with the end openings to permit access to said end openings in the final position.

2. A connector according to claim 1 wherein said shutter is slidable in a slot of said housing.

3. A connector according to claim 1 wherein said primary latch comprises an upstanding lance of each terminal, each lance being engageable with a respective abutment of said housing.

4. A connector according to claim 1 wherein said shutter comprises a planar member having a plurality of access openings adapted for alignment with said release openings in the temporary positions and said end openings in the final position.

5. A connector according to claim 4 wherein said access openings, end openings and release openings are arranged in a regular grid.

6. A connector according to claim 1 wherein said primary latch is between said retainer and said shutter.

7. A connector according to claim 2 wherein said shutter comprises a planar member having a plurality of access openings adapted for alignment with said release openings in the temporary position, and said end openings in the final position.

8. A connector according to claim 7 wherein said access openings, end openings and release openings are arranged in a regular grid.

9. A connector according to claim 1 wherein said shutter in said final position occludes said release openings and permits access only to said end openings.

* * * * *